US006890197B2

(12) United States Patent
Liebenow

(10) Patent No.: US 6,890,197 B2
(45) Date of Patent: May 10, 2005

(54) RJ-45 JACK WITH RJ-11 DETECTION

(75) Inventor: Frank Liebenow, Dakota Dunes, SD (US)

(73) Assignee: Gateway, Inc., Irvine, CA (US)

( * ) Notice: Subject to any disclaimer, the term of this patent is extended or adjusted under 35 U.S.C. 154(b) by 0 days.

(21) Appl. No.: 10/366,076

(22) Filed: Feb. 13, 2003

(65) Prior Publication Data

US 2004/0161964 A1 Aug. 19, 2004

(51) Int. Cl.[7] ..... H01R 13/71
(52) U.S. Cl. ..... 439/188; 439/676; 439/955
(58) Field of Search ..... 439/676, 188, 439/489, 955, 488

(56) References Cited

U.S. PATENT DOCUMENTS 4,699,443 A * 10/1987 Goodrich et al. ..... 439/188
5,772,466 A * 6/1998 Morin et al. ..... 439/489
5,773,901 A * 6/1998 Kantner ..... 307/125
5,842,045 A * 11/1998 Nakamura ..... 710/63
6,371,780 B1 * 4/2002 Aponte et al. ..... 439/188

* cited by examiner

*Primary Examiner*—Neil Abrams
(74) *Attorney, Agent, or Firm*—Jeffrey A. Proehl; Leonard & Proehl

(57) ABSTRACT

A method and apparatus for detecting plug types capable of being inserted into a socket includes a processor, a housing having a plug receiving cavity for one or more plug types including a proper and improper plug type. Actuators are associated with the housing, and are coupled to switches electrically coupled to the processor. A first actuator is capable of contacting the proper and improper plug type and a second actuator is capable of contacting only the proper plug type. Switches may provide a signal to the processor when the improper and proper plug type has been plugged into the socket.

12 Claims, 8 Drawing Sheets

670

| | RJ11 | RJ45 | Ø |
|---|---|---|---|
| SW1 | 1 | O | 1 |
| SW2 | O | O | 1 |

680

| | RJ11 | RJ45 | Ø |
|---|---|---|---|
| SW1 | O | 1 | O |
| SW2 | 1 | 1 | O |

RJ-45 JACK WITH RJ-11 DETECTION

FIELD OF THE INVENTION

The present invention generally relates to electrical connectors. More particularly, the present invention is related to connectors for computers and related electronic devices which can detect the presence of an improperly inserted plug.

BACKGROUND OF THE INVENTION

Electrical connectors are extremely diverse in type and number. However, standardization within certain industries such as, for example, the communications and computer industries has driven manufacturers to adopt the use of standard connectors in many applications. Interoperability between products made by a diversity of manufacturers within these and other industries is so important, particularly for network and telephone interfaces, that the use of proprietary or non-standard connectors for standard communications interfaces could likely compromise the marketability of products containing them and would be largely unthinkable.

As the computer and communications worlds have converged, the demand for interconnection between computers and, for example, the public phone system have driven computer makers to use standard connectors to facilitate such interconnection and the rich content available therefrom. Such standard connectors are also rugged, multi-sourced, reliable, and inexpensive. The RJ-series connector, such as the RJ-11 and RJ-45 connectors, represents such a standard connector. RJ stands for "Registered Jack" and is specified according to the standards called out in U.S. Federal Communications Commission rules and regulations, 47 C.F.R. 68. The RJ series connectors were originally developed by AT&T as a modular connection solution for telephone handsets and wall plugs and are now used by almost all telephone companies throughout the world. The RJ connectors are configured based on a connection form factor and an actual number of connections. For example, the RJ-11 and RJ-12 are the same size, e.g. A six connection form factor, with the RJ-11 having four connections and the RJ-12 having six connections. The connection protocol is typically center oriented so that modifications can be made without disturbing existing service. Although now used for many different applications, the most important use for the RJ series connectors, particularly the RJ-11 connector, is the interconnection of telephones, modems, and computers with telephone lines. Accordingly, stringent standardization of connectors has been established to enable compatibility and interoperability. Due to the simplicity of the connector design, the reliability of the connections, and the fact that the connectors are manufactured under established standards, RJ-series connectors are used extensively in the computer industries and in other industries where communication over telephone lines or standard interconnection is required.

The standard RJ-series modular connector includes a plug or contact block and a jack or socket having a certain number of mating contacts. The plug includes a small block shaped body typically having pressure activated blades which can be crimped on to a cable, such as a telephone line typically having individual conductors. The crimping action provides a connection between the individual conductors and the contact surface of the blade which is then positioned to contact a corresponding spring contact generally housed within the jack or socket. The outside of the body is molded with a flexible retention clip or key that allows the plug to be secured within the socket. A portion of the clip extends outside the plug/jack mating area to allow the plug to be easily disconnected by depressing the clip and pulling the plug.

The socket can be integrated into a circuit board and can be accessed through a port in the housing or enclosure of associated equipment or can be molded directly into an enclosure and wired to a circuit board. The socket may be mechanically configured to receive the plug and contains flexible contact wires aligned with and biased against corresponding contacts on the plug to complete the electrical connection between the plug and the electrical apparatus.

The interior surface of the socket includes a receiving notch for accepting the retention clip of the plug so as to mechanically secure the plug within the socket. Once the retention clip has snapped into place within the receiving notch through a flexing action of the retention clip away from the body of the plug, the plug is firmly held in place providing secure mechanical and electrical coupling. To remove the plug, the retention clip is manually flexed back towards the body of the plug to release the retention clip from the notch, enabling manual removal of the plug from the socket. While the basic characteristics and operation of the RJ-11 plug has been described herein, other RJ series plug and jacks are used extensively in electronic, computer, and communications devices and operate in the same basic manner.

The RJ-45 modular connector, for example, is used extensively for network interface interconnections and possesses many of the same basic characteristics of the RJ-11 plug described previously herein. The RJ-45 connector has a larger width dimension than the RJ-11 and is configured to facilitate eight connections. The RJ-11 is configured for four connections but has a form factor to accommodate six. It is important to note that perhaps due to legacy compatibility concerns, e.g. concerns that later versions of RJ designs would accept earlier designs, the RJ-45 connector although wider can accommodate an RJ-11 connector.

Problems arise however since although the RJ-11 plug may be plugged into an RJ-45 jack, the wiring of the RJ-45 may deviate from normal telephone connection protocol as it typically does for network connectivity commonly associated with modem applications of the RJ-45 form factor. Thus damage due to improper electrical connection is possible. And further, although detection of a properly inserted plug is relatively easy, the detection of an improperly inserted plug is not easily addressed as evidenced by the lack of adequate solutions in the art.

Some plugs have been configured to detect the presence of a jack therewithin as described for example in U.S. Pat. No. 5,378,165 issued on Jan. 3, 1995 to Comerci et al (hereinafter "Comerci"). The plug described in Comerci however is configured to detect a properly inserted plug and fails to teach or suggest how to deal with an improperly inserted plug. Comerci further appears to require that the plug be fully inserted before detection can occur. Still further, Comerci requires separate assemblies for the plug housing and detection means leading to increased cost of manufacture and assembly. In U.S. Pat. No. 5,772,466 issued on Jun. 30 1998 to Morin et al. (hereinafter "Morin"), a receptacle connector adapted for mating with at least two types of plug connectors is described. Morin's receptacle generates a signal when mating with one type connector and does not generate a signal when mating with the other type of connector. The obvious problem with Morin's approach is that there is no way to distinguish whether the lack of a signal indicates that an improper plug type is plugged into the receptacle or whether the receptacle is simply empty.

Thus, it would be desirable in the art for a solution to the abovementioned problems by providing for detection of an improperly inserted plug into a receptacle which can physically accommodate more than one plug type. In addition to detecting the improperly inserted plug it would be further desirable for the detection of a properly inserted plug.

SUMMARY OF THE INVENTION

Accordingly, the present invention is directed to a method and apparatus for detecting one or more plug type capable of being inserted into a socket. In one exemplary embodiment, the apparatus preferably includes a housing having a plug receiving cavity associated with the socket and at least one of the one or more plug type, that is, the plug receiving cavity may be configured to properly accept at least one of several plug types capable of being inserted therewithin, e.g. the proper plug type. The housing may include two or more actuators such that the proper plug type and an improper plug may be detected. Accordingly, a first actuator may be disposed within the plug receiving cavity such that when either the proper or the improper plug type is plugged into the socket the first actuator may be contacted thereby. Likewise, a second actuator may be disposed within the plug receiving cavity such that only when the proper plug type is plugged into the socket the second actuator may be contacted thereby. It should be noted that the one or more plug types may include RJ-11 and RJ-45 plug types, the improper plug type preferably being the RJ-11 plug type and the proper plug type preferably being the RJ-45 plug type.

In accordance with an alternative exemplary embodiment of the present invention, two or more actuators associated with the housing are preferably associated with two or more switches which, as will be appreciated by one skilled in the art can be normally open or normally closed. The switches may be electrically coupled to a processor such that, for example, the first switch associated with the first actuators generates a signal both when the proper plug type, e.g. the RJ-45 plug type, and when improper plug type, e.g. the RJ-11 or RJ-12 plug type, is inserted into the socket, which signal may be read by the processor. The second switch associated with the second actuator may also generate a signal only when the proper plug type, e.g. the RJ-45 plug type, is inserted into the socket. Thus the second switch will ultimately be determinative of whether the plug type is proper or improper, e.g. if the first switch is activated and the second switch is not activated an improper plug insertion has taken place. It should be noted that processor may be dedicated to the purpose of plug detection or may be a general purpose and/or central processor associated with equipment to which the plug types are connected to.

In accordance with yet another alternative exemplary embodiment of the present invention, the method for detecting one or more plug type capable of being inserted into a socket may include configuring a housing having a plug receiving cavity associated with the socket and at least the proper plug type with two or more actuators associated with the housing. The actuators may be formed, for example, during manufacture of the housing and may be constituted preferably as, for example, tabs pointing either toward or away from the opening of the cavity. As in other exemplary embodiments, the plug types may include a proper plug type and an improper plug type, the proper plug type preferably being the RJ-45 plug type, the improper plug type being the RJ-11 or RJ-12 plug type. The first actuator may be disposed within the plug receiving cavity such that it is capable of contacting both the proper, e.g. RJ-45 and the improper plug type, e.g the RJ-11 or RJ-12 plug type, when either the proper or the improper plug type is plugged into the socket. A second actuator may further be disposed within the plug receiving cavity such that it is capable of contacting only the proper plug type, e.g. the RJ-45 plug type, when the one or more plug type is plugged into the socket. Further in accordance with the present exemplary embodiment, the method may further include actuating a first switch with the first actuators, with the first switch being coupled electrically to a processor as previously described herein, and generating a first signal readable by the processor both when the proper and when the improper plug type are inserted into the socket. Likewise, a second switch may be actuated with the second actuator, the second switch also coupled electrically to a processor, and a second signal may be generated with the second switch only when the proper plug type is inserted into the socket.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

In accordance with various exemplary embodiments, the present invention solves the problem of detecting an improperly inserted plug by providing specific detection of the improperly inserted plug type. Such detection is made possible by factors including standard form factors and the fact that a specific type of improper plug type is normally expected.

Figure 1:
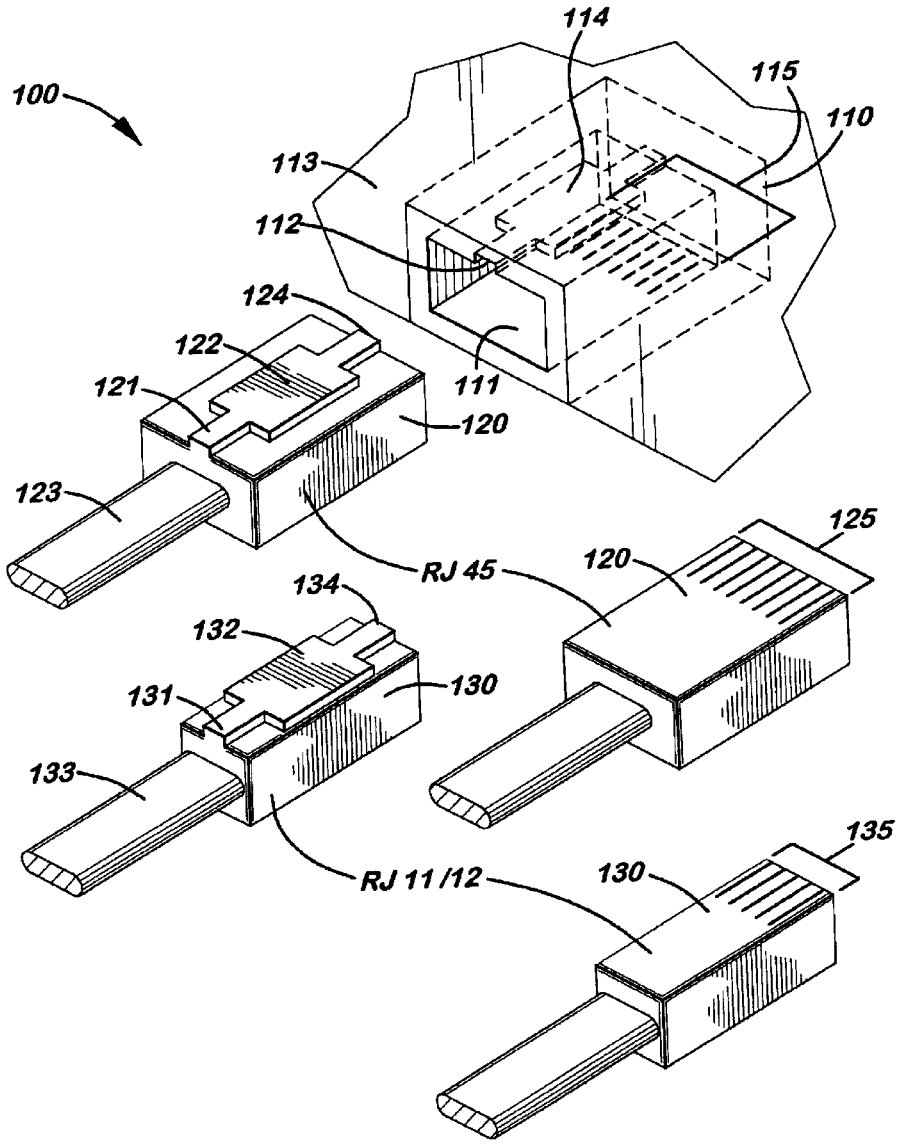
FIG. 1 is a diagram illustrating an exemplary RJ-45 receptacle and exemplary RJ-11 and RJ45 plug types in accordance with the prior art.
Figure 2:
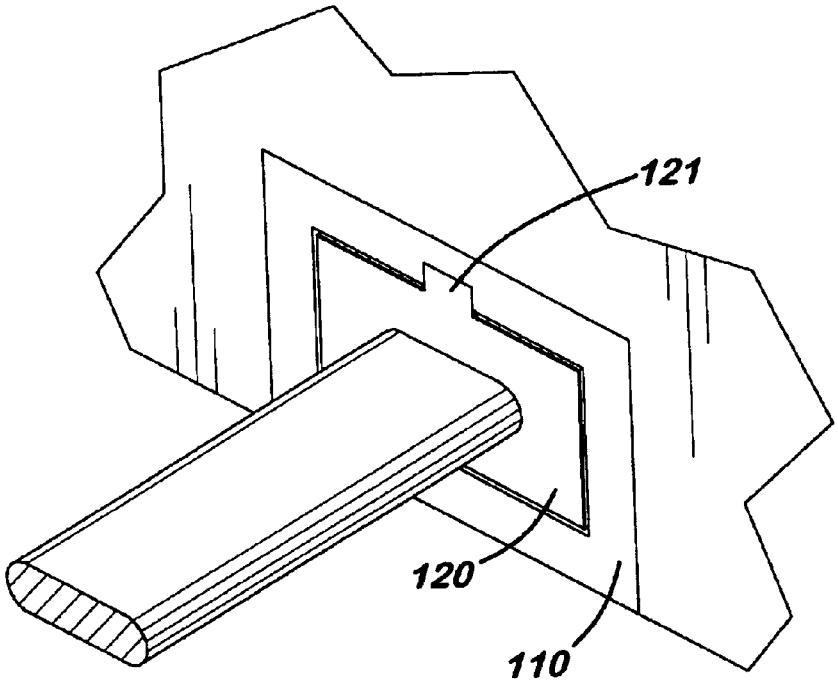
FIG. 2 is a diagram illustrating the exemplary RJ-45 receptacle and exemplary RJ-11 and RJ45 plug types of FIG. 1 plugged in accordance with the prior art.
Figure 2:
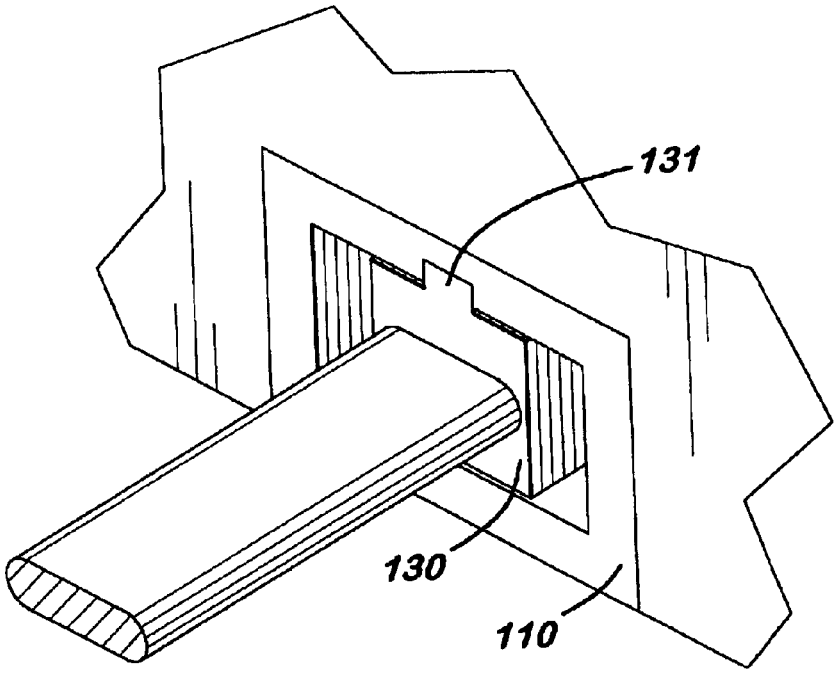

Thus, as can be seen from FIG. 1, a conventional plug and receptacle scenario 100 is shown. Receptacle 110 is a typical RJ-45 receptacle or jack configured most probably for multi-line telephone or network applications. Receptacle 110 is provided with a plug receiving cavity 111, which is configured to receive RJ-45 plug 120. In normal operation, RJ-45 plug 120 is fitted within plug receiving cavity 111 by holding either the body of the plug or conductor 123, which usually contains multiple conductors crimped as described hereinabove. RJ-45 plug 120 is then pushed entirely into plug receiving cavity 111 until restraining tab 122 fits within tab cavity 114 and RJ-45 plug contacts 125 come into contact with receptacle contacts 115. Because restraining tab 122 is spring biased at spring joint 124, the tab should "click" into place and thus provide solid contact as illustrated in FIG. 2. To remove RJ-45 plug 120, removal tab 121 may be pressed down at notch 112 to release restraining tab 122 from tab cavity 114 and remove RJ-45 plug 120. In an improper scenario, RJ-11/12 plug 130 is fitted within plug receiving cavity 111 by holding either the body of the plug or conductor 133. Because the height form factor is the same according to RJ-45 and RJ-11/12 standards, RJ-11/12 plug 130 may be pushed entirely into plug receiving cavity 111 until restraining tab 132 fits within tab cavity 114 and RJ-11/12 plug contacts 135 come into contact with a subset of receptacle contacts 115. As above, because restraining tab 132 is spring biased at spring joint 134, the tab should "click" into place and thus provide solid thought improper contact also illustrated in FIG. 2. To remove RJ-11/12 plug 130, removal tab 131 may be pressed down at notch 112 to release restraining tab 132 from tab cavity 114 and remove RJ-11/12 plug 130. It is important to note that serious problems may arise since typical applications for RJ-45 may not be telephone oriented, thus plugging an RJ-11/12 plug into an RJ-45 jack may cause unspecified electrical damage to either or both of the equipments connected to the plug side or jack side.

Figure 3A:
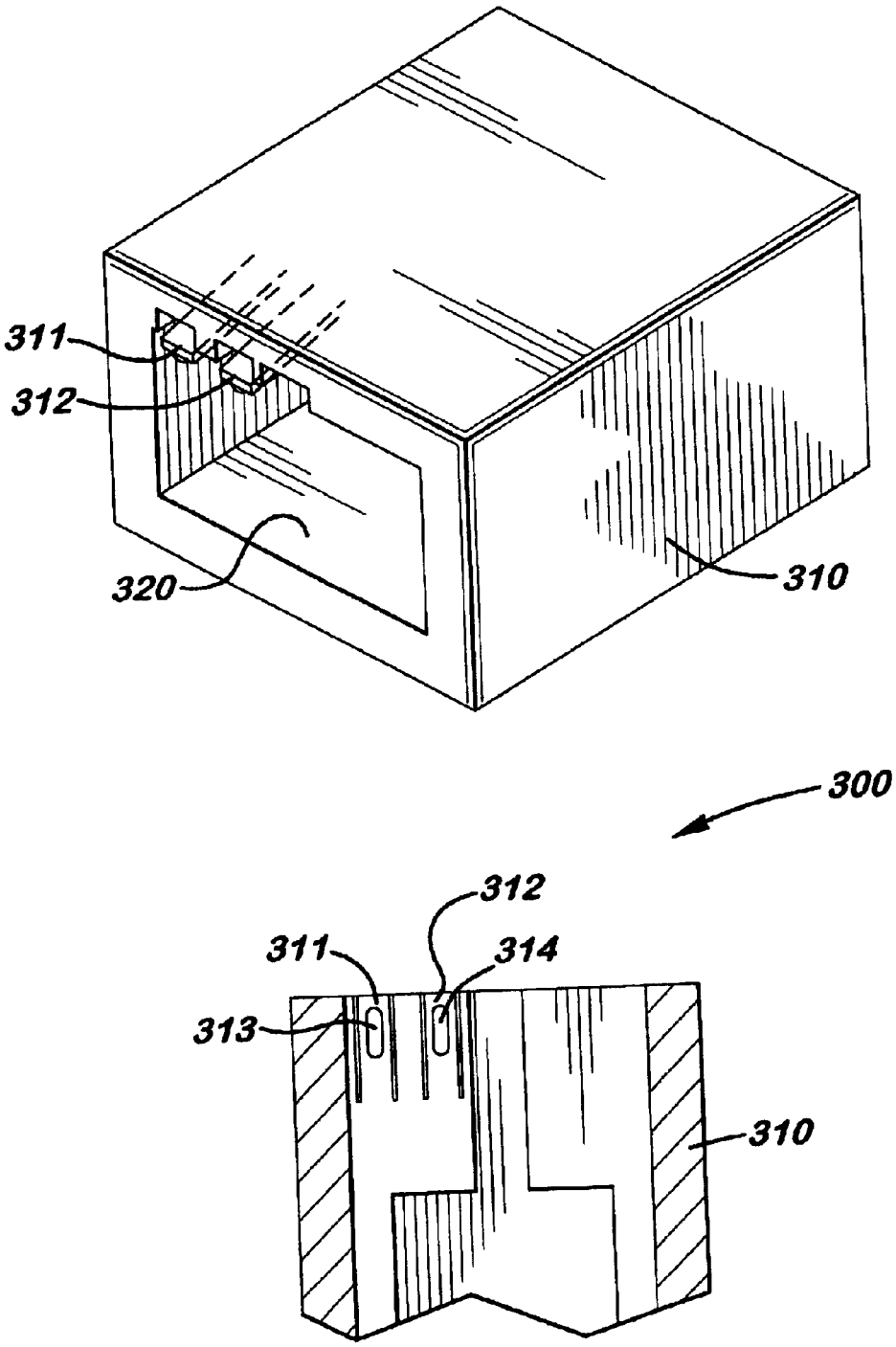
FIG. 3A is a diagram illustrating an exemplary receptacle having actuator tabs in accordance with various exemplary embodiments of the present invention.
Figure 3B:
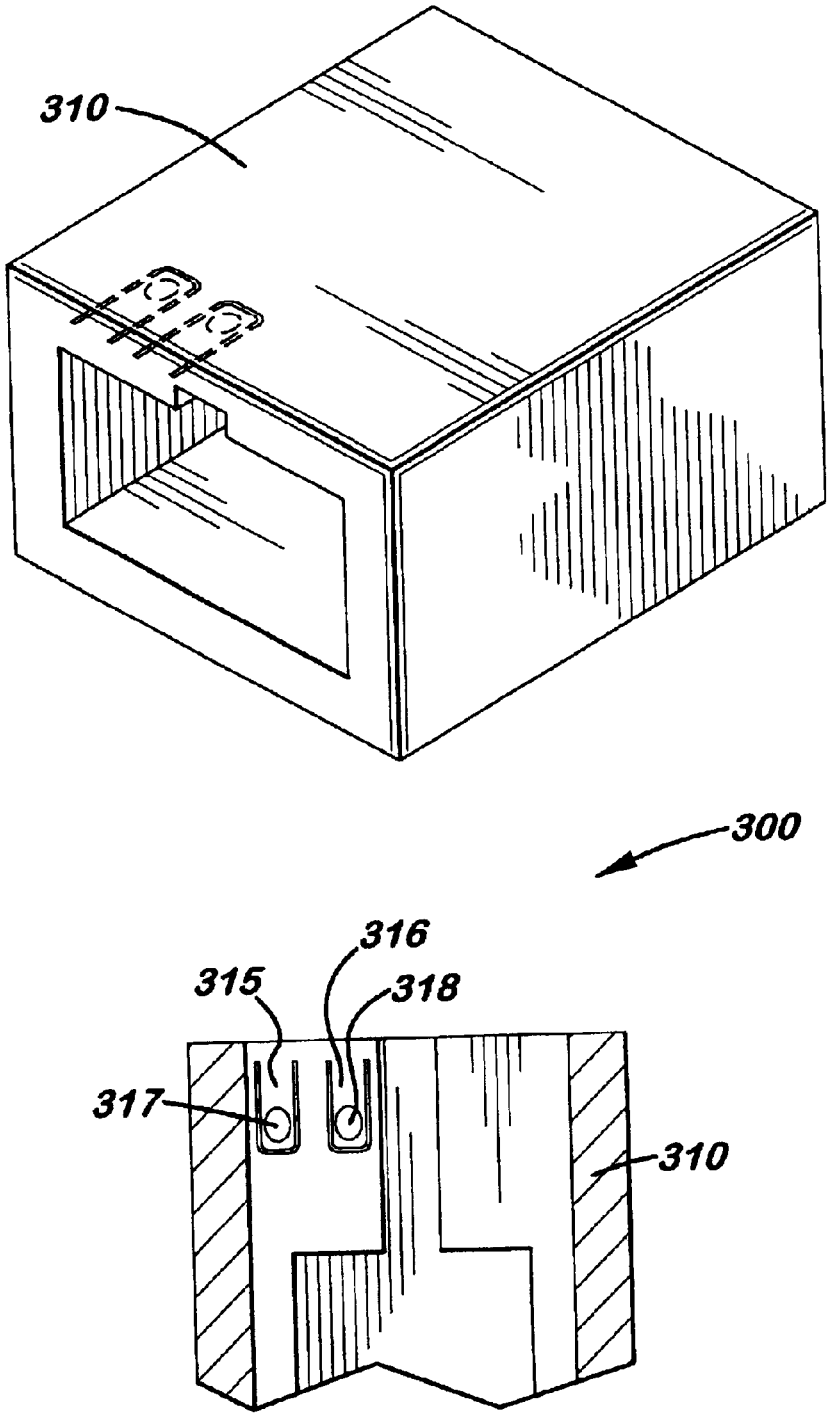
FIGS. 3B is a diagram illustrating an exemplary receptacle having actuator tabs in accordance with various alternative exemplary embodiments of the present invention.

To alleviate the problem of potential electrical damage to equipment, exemplary receptacle scenario 300 is shown in FIG.s 3A and 3B. As shown in FIG. 3A, exemplary receptacle 310 in accordance with various exemplary embodiments of the present invention may be fitted with exemplary actuator tab 311 and 312 for contacting both proper and improper plug types. It should be apparent to one skilled in the art that exemplary actuator tabs 311 and 312 may be formed during manufacture into, for example, plastic or whatever material is suitable for use in receptacle 310 provided the material is relatively springy and can withstand repeated flexing such as, for example, plastic or the like. It should be noted that actuator tabs 311 and 312 are shown for illustrative purposes slightly downward. Since it would be an obvious impediment to plugging for actuator tabs 311 and 312 to be positioned downward within plug receiving cavity 320, actuator tabs 311 and 312 are preferably flush with the side of plug receiving cavity 320 and may additionally be provided with contact cams 313 and 314 respectively. Thus when a properly or improperly inserted plug type is inserted into plug receiving cavity 320, one or more of contact cams 313 and 314 may contact the plug and either actuate a proximal external switch or may be integrated into a switch mechanism. Alternatively, as shown in FIG. 3B, actuator tabs 315 and 316 may be formed during manufacture directed in the plugging direction, that is, the free ends of actuator tabs 315 and 316 may be pointed toward the inside of plug receiving cavity 320 to ensure they don't interfere with plugging action. As described herein above with regard to actuator tabs 311 and 312, actuator tabs 315 and 316 may further be configured with contact cams 317 and 318 respectively.

Figure 4:
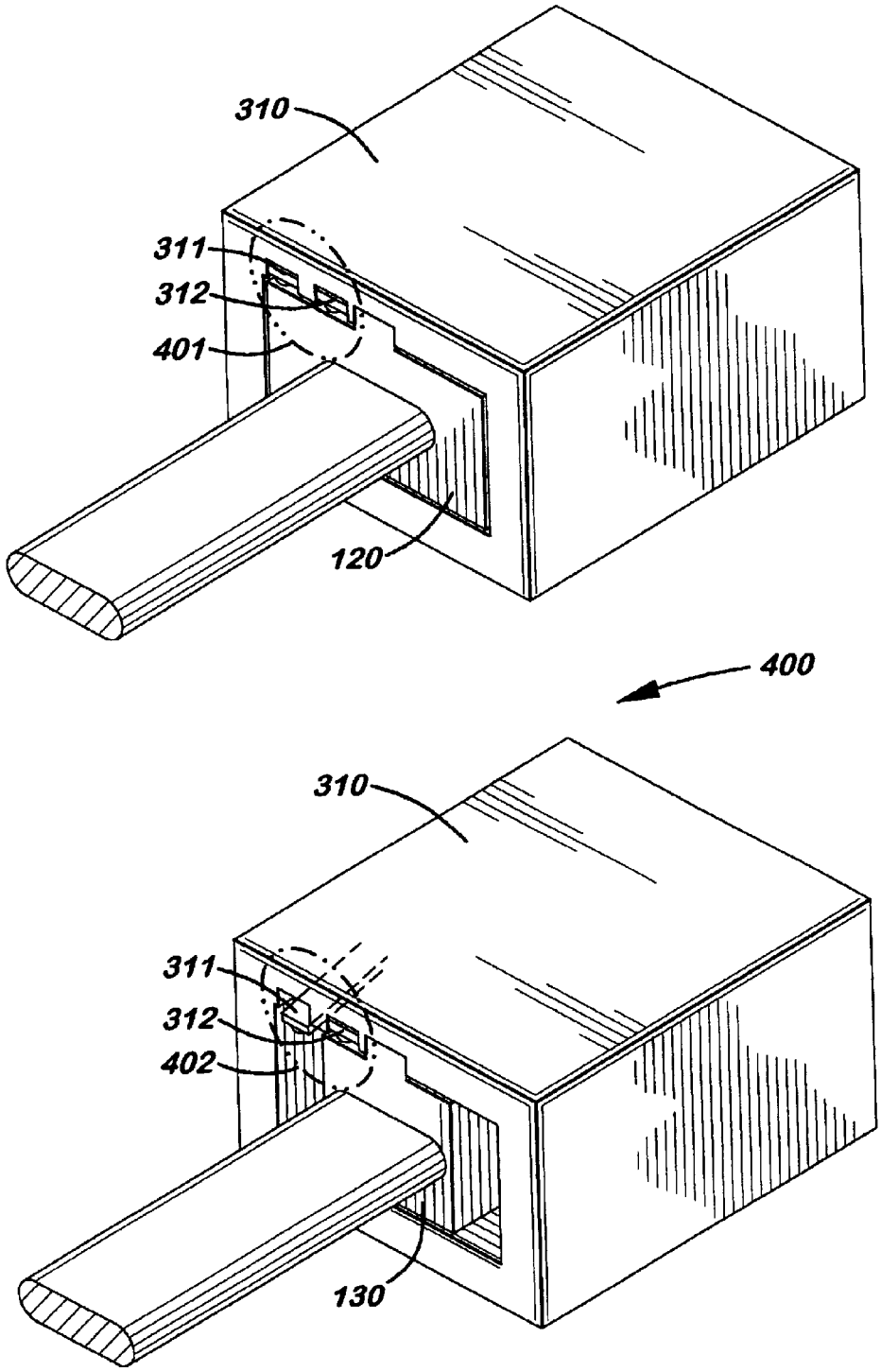
FIG. 4 is a diagram illustrating an exemplary receptacle with a proper and improper plug type making contact with actuator tabs in accordance with various exemplary embodiments of the present invention.

In a simple yet elegant manner, the present invention in its various exemplary embodiments, may be used to address the above described problems and detect the presence of both a proper and improper plug type as shown in FIG. 4. Plugging scenario 400 illustrates receptacle 310 with RJ-45 plug 120 inserted in proper fashion therewithin. Note that as shown in exemplary detail 401, both exemplary actuators 311 and 312 are activated when RJ-45 plug 120 is properly inserted. In exemplary detail 402, RJ-11/12 plug 130 is inserted in improper fashion into receptacle 310. Note that as shown, only exemplary actuator tab 312 is activated while exemplary actuator tab 311 remains un-activated. It should be apparent to one skilled in the art that while exemplary actuator tabs 311 and 312 are shown in a representative manner, any number of possible direct switch or mechanical switch actuators may be used without departing from the scope of the invention. Further, as previously described, exemplary actuator tabs 311 and 312 are shown as biased downward into plug receiving cavity 320 for illustrative purposes, exemplary actuator tabs 311 and 312 are, in various exemplary embodiments, preferably flush with the side wall of receptacle 310 and may further be provided with activation cams or the like to provide actuation pressure when either a proper or improper plug type is inserted.

Figure 5:
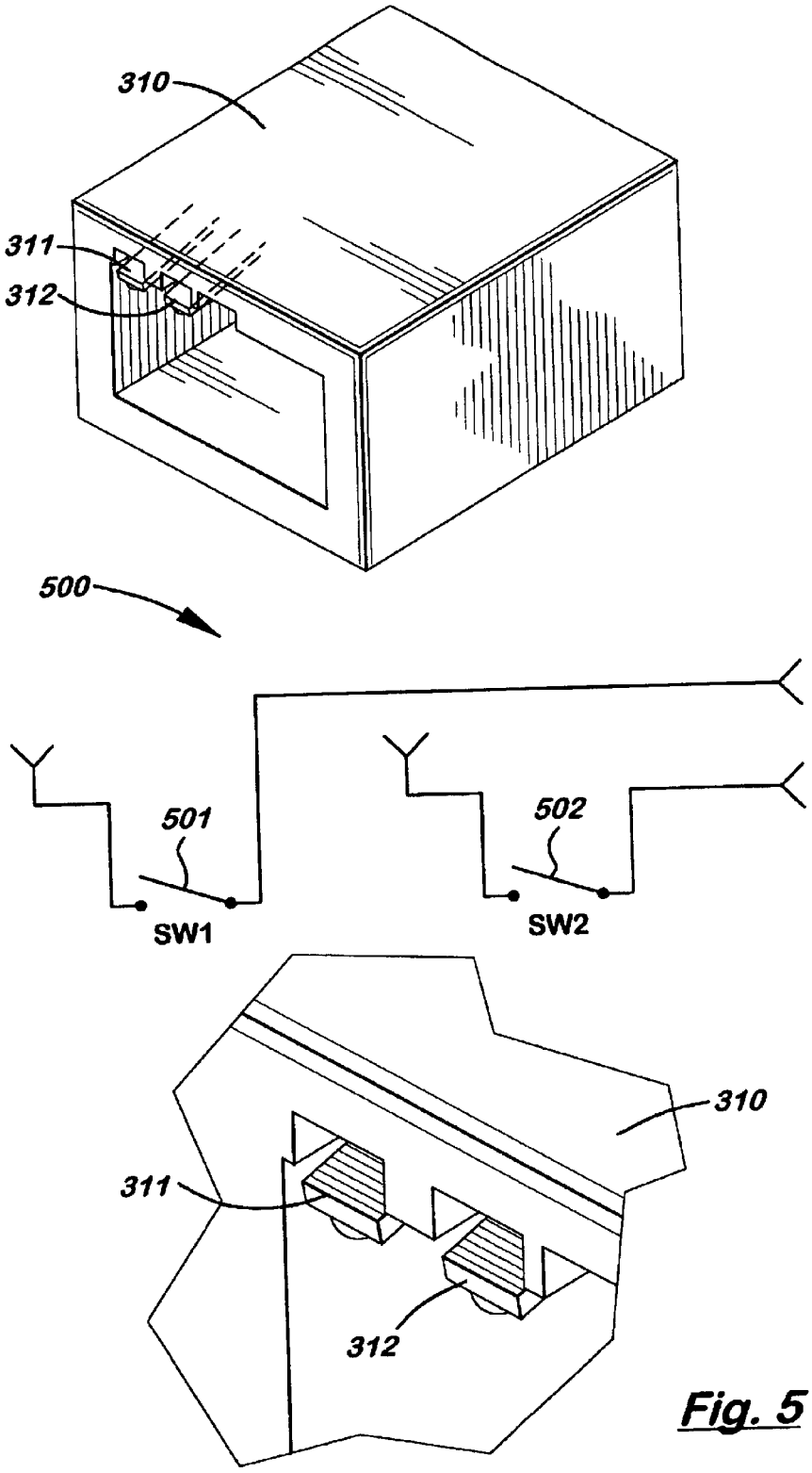
FIG. 5 is a diagram illustrating an exemplary receptacle with actuator tabs and a switch schematic in accordance with various exemplary embodiments of the present invention.

Accordingly, as can be seen in FIG. 5, exemplary actuator tabs 311 and 312 may preferably be coupled mechanically to a switch such as, for example, SW1 501 and SW2 502 (shown as normally open) or like logic elements preferably of the momentary type meaning that the switch contacts stay activated as long as the mechanical activation condition, e.g. insertion of the plug, is present and are inactivated when the mechanical activation condition is removed. It will be appreciated in the art that other types of mechanical and non-mechanical actuation may be used without departing from the scope of the invention. It will further be appreciated that in accordance with various exemplary embodiments of the present invention, normally open or normally closed switches may be used depending on the exact mechanical configuration desired or other considerations like part costs and the like.

Figure 6A:
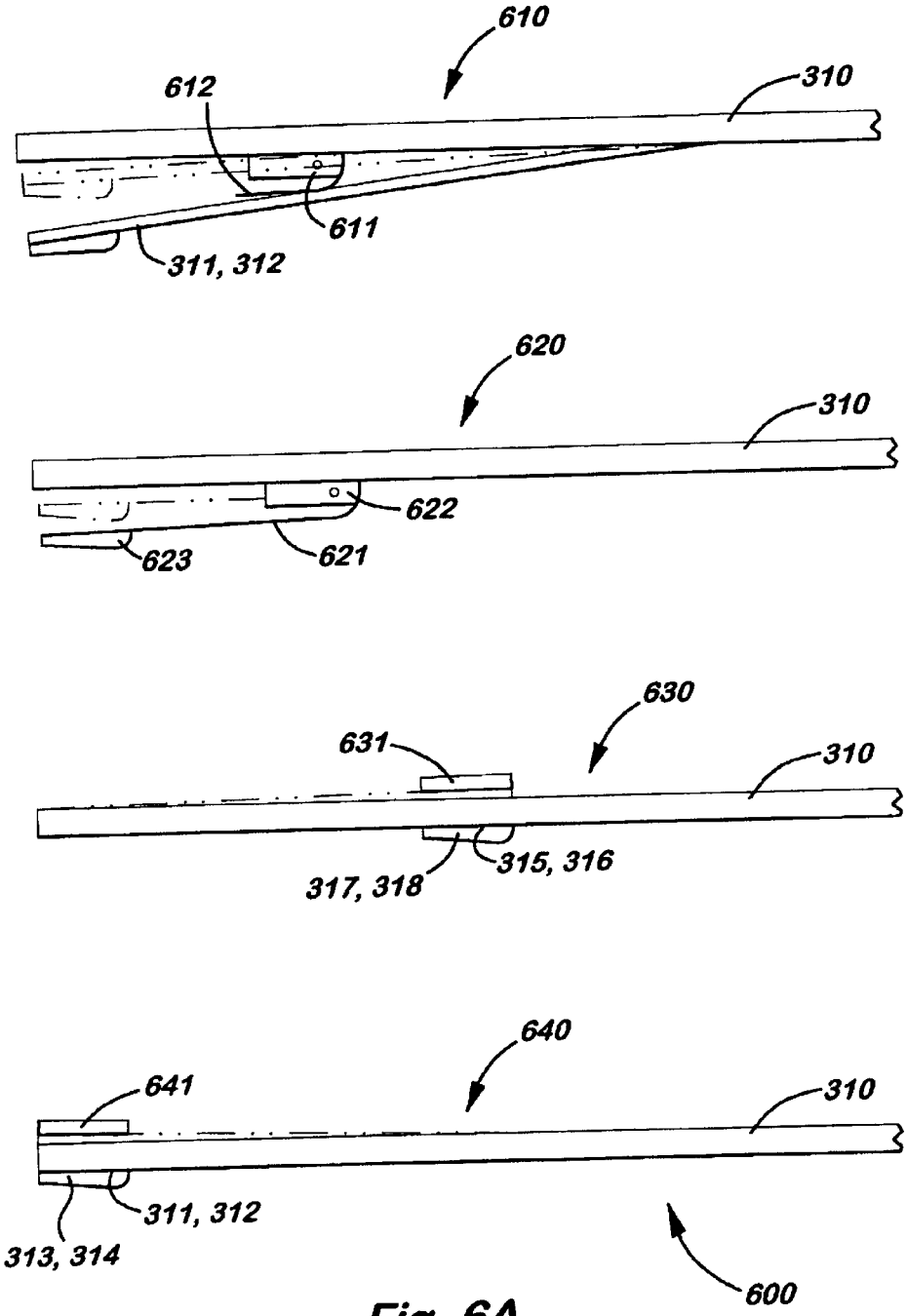
FIG. 6A is a diagram illustrating various exemplary actuator tab and switch configurations in accordance with various exemplary embodiments of the present invention.

It should be noted that as described previously herein, exemplary actuator tabs 311 and 312 may be used to actuate an external switch or may be an actual part of a switch element. FIG. 6A illustrates several exemplary switch and switch actuator configurations in accordance with various exemplary embodiments of the present invention. In configuration 610, for example, exemplary actuator tabs 311 and 312 are formed as tabs during the manufacture of receptacle housing 310. Switch element 611 is fixed either on receptacle 310 or externally such that when a proper or improper plug type is inserted one or more of exemplary actuator tabs 311 and 312 communicate mechanically with the contact arm 612 of switch element 611 closing or opening the switch contacts depending on whether the contacts of switch element 611 are normally open or normally closed. In configuration 620 switch element 622 is fixed to receptacle 310 or may be fixed externally. In either case, switch contact arm 621 may be elongated such that it may be used to directly contact an proper or improper plug type during insertion. Activation cam 623 may further be associated with switch contact arm 621 to ensure proper contact and to allow switch contact arm 621 to be positioned closer to the side of receptacle 310 and thus be further out of the way of interfering with plug insertion. Configuration 630 shows exemplary actuator tabs 315 and 316 manufactured such that they are flush with the side of receptacle 310 with one or more of activation cams 317 and 318 positioned to engage a proper or improper plug type. Once engaged, one or more of activation cams 317 and 318 may be used to press tabs 315 and/or 316 into contact with switch 631. Switch 631 may be a button switch or the like and may be fixed to receptacle 310 or may be fixed to an external structure in proximity to receptacle 310. In yet another configuration 640, actuator tabs 311 and 312 by way of activation cams 313 and 314 may be pressed into engagement with switch 641 during plug insertion. Again, switch 641 may be a button or any other suitable type of switch element which can be activated by the mechanical act of plug insertion.

Figure 6B:
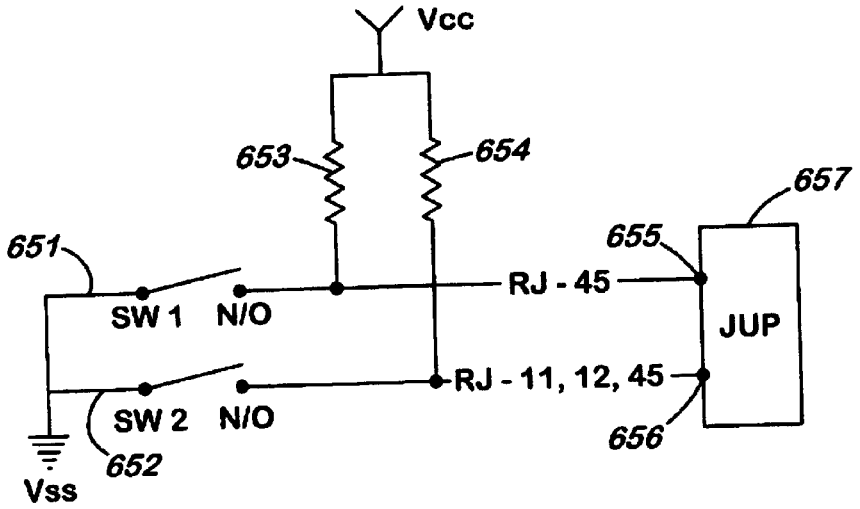
FIG. 6B is a schematic diagram illustrating exemplary switch configurations with corresponding truth tables in accordance with various exemplary embodiments of the present invention.
Figure 6B:
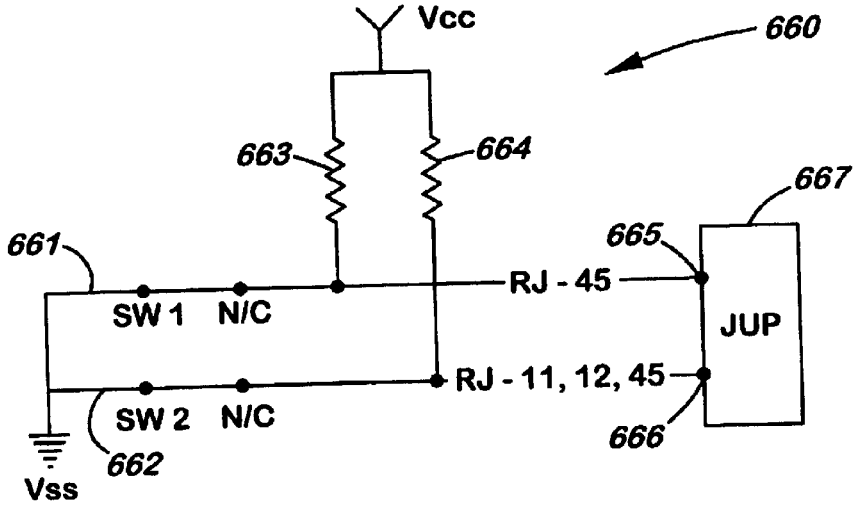

As will be appreciated by one skilled in the art and as is shown in FIG. 6B, several switching scenarios may be used in accordance with various exemplary embodiments of the present invention. In scenario 650, SW1 651 and SW2 652 are preferably normally open, single pole single throw (SPST) momentary switches or equivalent. During inactive quiescent state, logic levels as seen at input pins 655 and 656 of processor 657 should be pulled high to $V_{cc}$ through pull up resistors 653 and 654. When either of SW1 651 or SW2 652 are closed, the corresponding logic levels as seen at input pins 655 or 656 of processor 657 should be pulled low to ground potential or $V_{ss}$. In yet another exemplary scenario 660, SW1 661 and SW2 662 are SPST normally closed momentary switches or equivalent. When either of SW1 661 and SW2 662 are opened during plugging, corresponding logic levels as seen at input pins 665 or 666 of processor 667 should be pulled high to $V_{cc}$ through pull up resistors 653 and 654. When SW1 661 or SW2 662 are closed again, the corresponding logic levels as seen at input pins 655 and 656 of processor 667 should be pulled low to ground potential or $V_{ss}$.

A summary of logical states corresponding to the possible proper and improper plug type insertion associated with scenarios 650 and 660 is shown in FIG. 6B. Therein it can be seen that for scenario 650, state table 670 shows that with no plugs inserted both logic levels associated with SW1 651 and SW2 652 are high. For a proper RJ-45 plug type insertion, both SW1 651 and SW2 652 will be activated and a low state will be asserted to processor 657 on both pins 655 and 656. For an improper RJ-11/12 plug insertion, only SW2 652 will be activated causing a low logic level at pin 656 of processor 657. Conversely, for scenario 660, state table 680 shows that with no plugs inserted, both logic levels associated with SW1 661 and SW2 662 are low. For a proper RJ-45 plug type insertion, both SW1 661 and SW2 662 will be activated and a high state will be asserted to processor 667 on both pins 665 and 666. For an improper RJ-11/12 plug insertion, only SW2 662 will be activated causing a low logic level at pin 666 of processor 667. It should be noted that exemplary processors 657 and 667 may be either specialized processors for the detection of plug type insertion or may be read by the main processor of a computer or any similar processor which relies on the detection of proper and improper plug type insertion such as, for example, a communications processor. It should further be noted that the detection of proper and improper plug type insertion may be useful to low and/or high level software such as network communications software, socket-type software, hot plug software, driver software or the like such that electrical power to the plug may be inhibited until proper plug insertion is detected. Plug removal may also be detected such that error messages may be generated and communications suspended without data loss. It will be appreciated that error messages may include pop-up software windows which indicate that the improper plug has been inserted, and may further contain instructions, e.g. remove the improper plug and replace it with the proper plug, or the like.

It is believed that plug type detection in accordance with various exemplary embodiments of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An apparatus for detecting one or more plug type capable of being inserted into a socket, the apparatus comprising:

a housing having a plug receiving cavity associated with the socket; and two or more actuators associated with the housing;

wherein the one or more plug type includes a proper plug type and an improper plug type, wherein the proper plug type includes a conventional RJ-45 plug type capable of being inserted in a conventional RJ-45 socket type and the improper plug type includes a conventional RJ-11 plug type capable of being inserted into a conventional RJ-11 socket type, and wherein a first one of the two or more actuators is disposed within the plug receiving cavity and is configured to be moved by the proper conventional RJ-45 plug type and by the improper conventional RJ-11 plug type when the proper and improper plug types are plugged into the socket, wherein a second one of the two or more actuators is disposed within the plug receiving cavity and is configured to be moved by the proper conventional RJ-45 plug type when the proper plug type is plugged into the socket and is configured not to be moved by the improper conventional RJ-11 plug type when the improper plug type is plugged into the socket.

2. The apparatus as claimed in claim 1, wherein the two or more actuators include two or more switches.

3. The apparatus as claimed in claim 2, wherein the two or more switches are normally open.

4. The apparatus as claimed in claim 2, wherein the two or more switches are normally closed.

5. The apparatus as claimed in claim 1, wherein the second one of the two or more actuators is configured to indicate when the improper plug type is inserted if the first one of the two or more actuators is contacted and the second one of the two or more actuators is not contacted.

6. The apparatus as claimed in claim 2, further including a processor, wherein the processor is coupled electrically to the two or more switches and wherein the switch associated with the first one of the actuators generates a signal both when the proper and when the improper plug type is inserted into the socket and the switch associated with the second one of the actuators generates a signal only when the proper plug type is inserted.

7. The apparatus as claimed in claim 5, further including a processor, wherein the processor is coupled electrically to two or more switches is associated with the first one of the actuators and generates a signal when the proper and improper plug type is inserted into the socket one of the two or more switches is associated with the second one of the actuators and generates a signal only when the proper plug type is inserted into the socket.

8. An apparatus for detecting one or more plug type capable of being inserted into a socket, the apparatus comprising:

a processor;

a housing having a plug receiving cavity associated with the socket, the one or more plug type including a proper plug type and an improper plug type, wherein the proper plug type includes a conventional RJ-45 plug type capable of being inserted in a conventional RJ-45 socket type and the improper plug type includes a conventional RJ-11 plug type capable of being inserted into a conventional RJ-11 socket type; and two or more actuators associated with the housing, the two or more actuators coupled to two or more switches, the two or more switches electrically coupled to the processor;

wherein a first of the two or more actuators is disposed within the plug receiving cavity and is configured to be moved by the proper conventional RJ-45 plug type and by the improper conventional RJ-11 plug type when the proper and improper plug types are plugged into the socket; and wherein the first actuator is capable of actuating a first one of the two or more switches so as to provide a signal to the processor when the improper conventional RJ-11 plug type has been plugged into the socket and when the proper conventional RJ-45 plug type has been plugged into the socket.

9. The apparatus as claimed in claim 8, wherein a second of the two or more actuators is disposed within the plug receiving cavity and is configured to be moved by the proper conventional RJ-45 plug type when the proper plug type is plugged into the socket and wherein the second actuator is capable of actuating a second one of the two or more switches so as to provide a signal to the processor when the proper conventional RJ-45 plug type has been plugged into the socket and is incapable of actuating the second one of the two or more switches so as not to provide a signal to the processor when the improper conventional RJ-11 plug type is plugged into the socket.

10. A method for detecting one or more plug type capable of being inserted into a socket, the method comprising:

configuring a housing having a plug receiving cavity associated with the socket with two or more actuators associated with the housing, wherein the one or more plug type includes a proper plug type and an improper plug type, wherein the proper plug type includes a conventional RJ-45 plug type capable of being inserted in a conventional RJ-45 socket type and the improper plug type includes a conventional RJ-11 plug type capable of being inserted into a conventional RJ-11 socket type;

disposing a first one of the two or more actuators within the plug receiving cavity such that the first one is configured to be moved by the proper conventional RJ-45 plug type and by the improper conventional RJ-11 plug type when the proper plug type is plugged into the socket and when the improper plug type is plugged into the socket; and disposing a second one of the two or more actuators within the plug receiving cavity such that the second one is configured to be moved by the proper conventional RJ-45 plug type when the proper plug type is plugged into the socket and is configured not to be moved by the improper conventional RJ-11 plug type when the improper plug type is plugged into the socket.

11. The method according to claim 10, further including the step of:

actuating a first switch with the first one first one of the two or more actuators, the first switch coupled electrically to a processor, and generating a first signal with the first switch both when the proper and when the improper plug type is inserted into the socket.

12. The method of claim 11, further including the steps of:

actuating a second switch with the second one of the two or more actuators, the second switch coupled electrically to a processor, and generating a second signal with the second switch only when the proper plug type is inserted into the socket.

* * * * *